US006915771B2

(12) United States Patent
Watanabe

(10) Patent No.: US 6,915,771 B2
(45) Date of Patent: Jul. 12, 2005

(54) BATTERY CABLE LAYOUT FOR OUTBOARD MOTOR

(75) Inventor: Hitoshi Watanabe, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 484 days.

(21) Appl. No.: 10/072,645

(22) Filed: Feb. 7, 2002

(65) Prior Publication Data

US 2002/0129784 A1 Sep. 19, 2002

Related U.S. Application Data

(60) Provisional application No. 60/322,345, filed on Sep. 13, 2001.

(30) Foreign Application Priority Data

Feb. 7, 2001 (JP) ..... 2001-030667

(51) Int. Cl.[7] ..... F02P 23/00
(52) U.S. Cl. ..... 123/143 C; 123/184.21
(58) Field of Search ..... 123/143 C, 184.21, 123/184.22, 184.52

(56) References Cited

U.S. PATENT DOCUMENTS 5,203,292 A 4/1993 Motose
5,488,939 A 2/1996 Nakai et al.
5,501,188 A 3/1996 Fukuoka
5,713,771 A 2/1998 Takahashi et al.
5,829,402 A 11/1998 Takahashi et al.
5,832,888 A 11/1998 Griffiths et al.
5,899,197 A 5/1999 Watanabe et al.
6,257,940 B1 7/2001 Dunham et al.

*Primary Examiner*—Bibhu Mohanty
(74) *Attorney, Agent, or Firm*—Knobbe, Martens, Olson & Bear LLP.

(57) ABSTRACT

An engine for an outboard motor includes one or more intake conduits that extend along an engine body thereof. A bracket supports one cable terminal disposed generally in a space formed between the engine body and the intake conduits. The cable terminal includes a coupling member that has first and second coupling ends. The first coupling end is connected to a starter motor by a first cable that extends within the space. The second coupling end is positioned to expose itself between the intake conduits and is connectable to an anode of a battery disposed on an associated watercraft by a second cable. The bracket defines another cable terminal disposed generally in the space. The another cable terminal is also positioned to expose itself between the intake conduits and is connectable to a cathode of the battery by a third cable.

17 Claims, 5 Drawing Sheets

BATTERY CABLE LAYOUT FOR OUTBOARD MOTOR

PRIORITY INFORMATION

This application is based on and claims priority to Japanese Patent Application No. 2001-030667, filed Feb. 7, 2001, the entire contents of which is hereby expressly incorporated by reference. This application further claims the benefit of U.S. Provisional Application No. 60/322,345, filed Sep. 13, 2001.

BACKGROUND OF THE INVENTION

1. Field of the Invention

The present invention relates generally to a battery cable layout for an outboard motor, and more particularly to an improved battery cable layout comprising a terminal construction disposed on the outboard motor.

2. Description of Related Art

Internal combustion engines for outboard motors typically employ various electrical components, such as starter motors and computer-based components, for instance. Generally, a battery is provided to supply electric power to the components, although an AC generator also can supply power to some of them. In most cases, the starter motor needs DC power supplied by the battery because the generator only generates power after the engine is operating.

Typically, the battery for an outboard motor is located on a hull of an associated watercraft. A battery cable assembly that includes a pair of cables connects cable terminals on the engine with terminals of the battery. More specifically, one of the cables connects one terminal of the engine with the anode terminal of the battery with the other of the cables connects the other terminal of the engine with the cathode terminal of the battery. Still another cable further connects the cable terminal that is connected with the anode terminal of the battery to the starter motor. The cable terminals usually are affixed to a bracket extending from an engine body of the engine.

Conventionally, the coupling of the battery cable assembly with the cable terminals is made during manufacturing of the outboard motor. The battery cable assembly extends out of a protective cowling assembly surrounding the engine so that the other end of the battery cable assembly is connectable with the battery when the outboard motor is mounted onto the associated watercraft. Recently, however, watercraft which can associate with the outboard motors have a great variety of configurations and sizes. Moreover, locations of the battery on the respective watercraft and/or the numbers of the batteries vary with each watercraft. Accordingly, the battery cables recently have been wired with the watercrafts in advance and then are coupled with the cable terminals of the outboard motors.

On the other hand, some of the outboard motors have one or more intake conduits extending along the engine body. Because the outboard motor typically has only a quite limited space around the engine body due to the compact nature and the intake conduits can occupy a large area of the limited space, only a narrow space is available for the cable terminals. In addition, even though additional space could be created, access to the cable terminals might still be difficult and, on many occasions, one or more engine components would need to be detached to allow installation of the battery cable assembly to the cable terminals.

SUMMARY OF THE INVENTION

A need therefore exists for an improved battery cable layout for an outboard motor that can provide easy access to cable terminals disposed at the engine even if one or more intake conduits extend along an engine body.

In accordance with one aspect of the present invention, an internal combustion engine for an outboard motor comprises an engine body. A moveable member is moveable relative to the engine body. The engine body and the moveable member together define at least one combustion chamber. An air intake system is arranged to introduce air to the combustion chamber. The intake system includes an intake conduit extending along at least part of the engine body. A cable terminal is disposed generally in a space formed between the engine body and the intake conduit. The cable terminal includes a coupling member having at least first and second coupling ends. The first coupling end is connected to at least one electrical component of the engine by a first cable that extends at least in part within the space. The second coupling end is positioned to expose itself either above or below the intake conduit and is adapted to be connected to an anode of a battery by a second cable.

In accordance with another aspect of the present invention, an internal combustion engine for an outboard motor comprises an engine body. A moveable member is moveable relative to the engine body. The engine body and the moveable member together define at least one combustion chamber. An air intake system is arranged to introduce air to the combustion chamber. The intake system includes an intake conduit extending along at least part of the engine body. A cable terminal is disposed generally in a space formed between the engine body and the intake conduit. The cable terminal is positioned to expose itself either above or below the intake conduit and is adapted to be connected to a cathode of a battery by a cable.

In accordance with a further aspect of the present invention, an internal combustion engine for an outboard motor comprises an engine body. A moveable member is moveable relative to the engine body. The engine body and the moveable member together define at least one combustion chamber. An air intake system is arranged to introduce air to the combustion chamber. The intake system includes an intake conduit extending along at least part of the engine body. At least one cable terminal is disposed generally in a space formed between the engine body and the intake conduit. The cable terminal is positioned to expose itself either above or below the intake conduit and is adapted to be connected to an anode or cathode of a battery by a cable.

BRIEF DESCRIPTION OF THE DRAWINGS

These and other features, aspects and advantages of the present invention will now be described with reference to the drawings of a preferred embodiment, which embodiment is intended to illustrate and not to limit the present invention. The drawings comprise five figures.

DETAILED DESCRIPTION OF THE PREFERRED EMBODIMENT OF THE INVENTION

Figure 1:
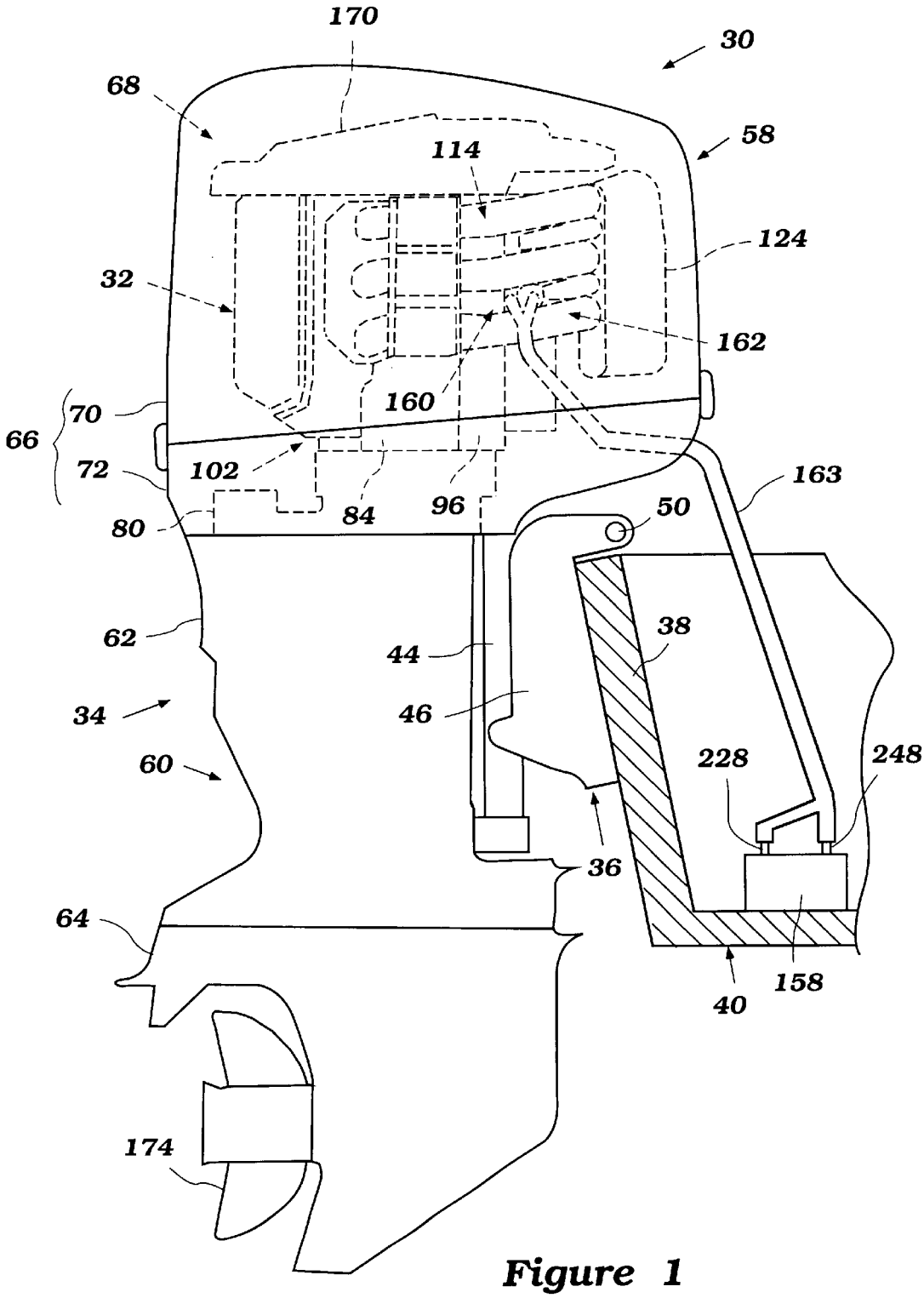
FIG. 1 is a side elevational view of an outboard motor configured in accordance with certain features, aspects and advantages of the present invention. An associated watercraft is partially shown in section.
Figure 2:
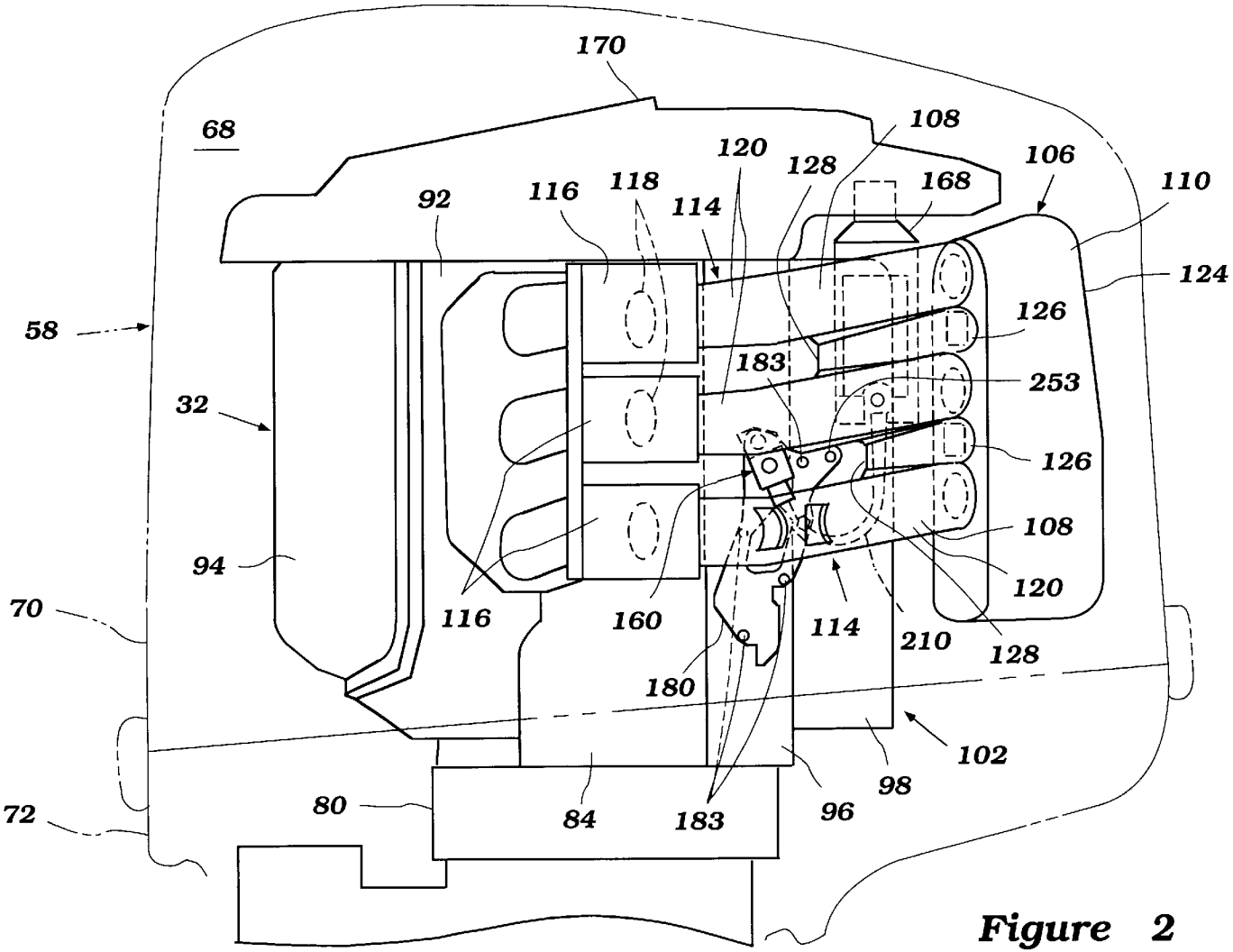
FIG. 2 is an enlarged side elevational view of an engine of the outboard motor. A protective cowling is shown in phantom line. A battery cable is not shown in this drawing.
Figure 3:
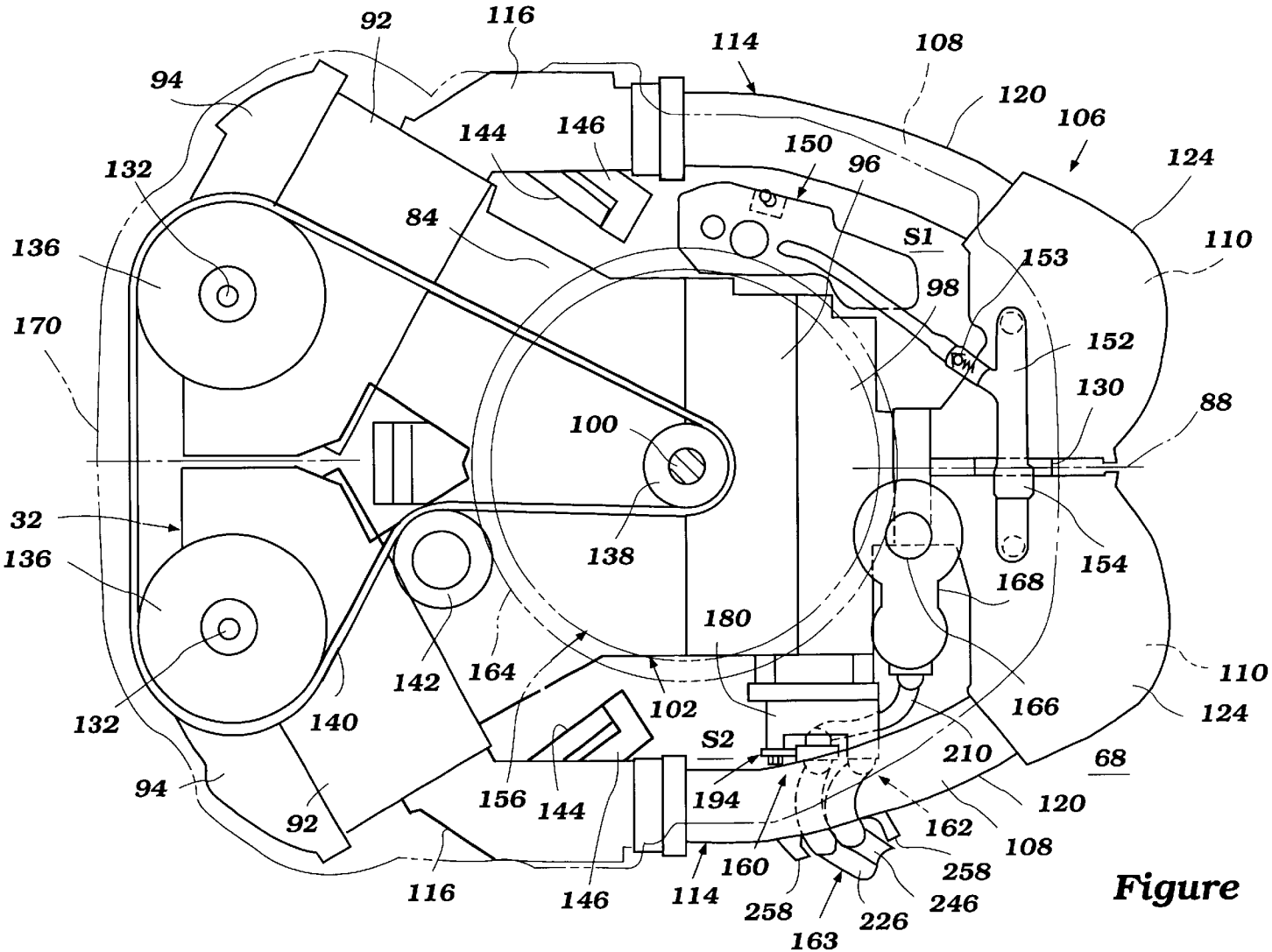
FIG. 3 is a top plan view of the engine. An engine cover and a flywheel magneto are shown in phantom line.

With reference to FIGS. 1–3, an overall construction of an outboard motor 30 that employs a battery connection arranged and configured in accordance with certain features, aspects and advantages of the present invention will be described. An engine 32 preferably is mounted within the outboard motor.

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface of a body of water. The bracket assembly 36 preferably comprises a swivel bracket 44, a clamping bracket 46, a steering shaft and a pivot pin 50.

The steering shaft typically extends through the swivel bracket 44 and is affixed to the drive unit 34. The steering shaft is pivotally journaled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used in this description, the terms "forward," "forwardly" and "front" mean at or to the side where the bracket assembly 36 is located, unless indicated otherwise or otherwise readily apparent from the context of use. The terms "rear," "reverse," "backwardly" and "rearwardly" mean at or to the opposite side of the front side.

A hydraulic tilt and trim adjustment system preferably is provided between the swivel bracket 44 and the clamping bracket 46 for tilt movement (raising or lowering) of the swivel bracket 44 and the drive unit 34 relative to the clamping bracket 46. Otherwise, the outboard motor 30 can have a manually operated system for tilting the drive unit 34.

The illustrated drive unit 34 comprises a power head 58 and a housing unit 60, which includes a driveshaft housing 62 and a lower unit 64. The power head 58 is disposed atop the housing unit 60 and includes the internal combustion engine 32 that is positioned within a protective cowling assembly 66, which preferably is made of plastic. In most arrangements, the protective cowling assembly 66 defines a generally closed cavity 68 in which the engine 32 is disposed. The engine, thus, is generally protected from environmental elements by the enclosure defined by the cowling assembly 66.

The protective cowling assembly 66 preferably comprises a top cowling member 70 and a bottom cowling member 72. The top cowling member 70 preferably is detachably affixed to the bottom cowling member 72 by a coupling mechanism to provide access to the engine 32 for maintenance or for other purposes.

The top cowling member 70 preferably has a rear intake opening (not shown) defined through an upper rear portion. A rear intake member with one or more air ducts can be unitarily formed with or affixed to the top cowling member 70. The rear intake member, together with the upper rear portion of the top cowling member 70, generally defines a rear air intake space. Ambient air is drawn into the closed cavity 68 via the rear intake opening and the air ducts of the rear intake member. Typically, the top cowling member 70 tapers in girth toward its top surface, which is in the general proximity of the air intake opening. The taper helps to reduce the lateral dimension of the outboard motor, which helps to reduce the air drag on the watercraft 40 during movement.

The bottom cowling member 72 preferably has an opening through which an upper portion of an exhaust guide member 80 extends. The exhaust guide member 80 preferably is made of aluminum alloy and is affixed atop the driveshaft housing 62. The bottom cowling member 72 and the exhaust guide member 80 together generally define a tray. The engine 32 is placed onto this tray and can be affixed to the exhaust guide member 80. The exhaust guide member 80 also defines an exhaust discharge passage through which burnt charges (e.g., exhaust gases) from the engine 32 pass.

The engine 32 in the illustrated embodiment preferably operates on a four-cycle combustion principle. With reference now to FIGS. 2 and 3, the presently preferred engine 32 is a DOHC six cylinder engine and has a cylinder block 84 configured as a V shape. The cylinder block 84 thus defines two cylinder banks which extend side by side with each other. In the illustrated arrangement, each cylinder bank has three cylinder bores such that the cylinder block 84 has six cylinder bores in total. The cylinder bores of each bank extend generally horizontally and are generally vertically spaced from one another. This type of engine, however, merely exemplifies one type of engine. Engines having other numbers of cylinders, having other cylinder arrangements (in-line, opposing, etc.), and operating on other combustion principles (e.g., crankcase compression two-stroke or rotary) also can be used. The illustrated engine 32 generally is symmetrical about a longitudinal center plane 88 (FIG. 3) that extends generally vertically and fore to aft of the outboard motor 30.

As used in this description, the term "horizontally" means that the subject portions, members or components extend generally in parallel to the water surface (i.e., generally normal to the direction of gravity) when the associated watercraft 40 is substantially stationary with respect to the water surface and when the drive unit 35 is not tilted (i.e., is placed in the position shown in FIG. 1). The term "vertically" in turn means that portions, members or components extend generally normal to those that extend horizontally.

Because the cylinder block 84 is split into the two cylinder banks, each cylinder bank extends outward at an angle to an independent first end in the illustrated arrangement. A pair of cylinder head members 92 are affixed to the respective first ends of the cylinder banks to close those ends of the cylinder bores. The cylinder head members 92 together with the associated pistons and cylinder bores, preferably define six combustion chambers (not shown). Of course, the number of combustion chambers can vary, as indicated above. Each of the cylinder head member 92 is covered with a cylinder head cover member 94 in the illustrated arrangement.

A crankcase member 96 is coupled with the cylinder block 84 and a crankcase cover member 98 is connected to the crankcase member 96. The crankcase member 96 and the crankcase cover member 98 close the other end of the cylinder bores and, together with the cylinder block 84, defines a crankcase chamber. A crankshaft 100 extends generally vertically through the crankcase chamber and can be journaled for rotation about a rotational axis by several bearing blocks. The rotational axis of the crankshaft 100 preferably is positioned along the longitudinal center plane 88. Connecting rods couple the crankshaft 100 with the respective pistons in any suitable manner. Thus, the reciprocal movement of the pistons rotates the crankshaft 100.

Preferably, the crankcase cover member 98 is located at the forward-most position of the engine 32, with the crankcase member 96, the cylinder block 84, the cylinder head members 92 and the cylinder head cover members 94 being disposed rearward from the crankcase cover member 98, one after another. In the illustrated arrangement, the cylinder block 84, the cylinder head members 92, the cylinder head cover members 94, the crankcase member 96 and the crankcase cover member 98 together define an engine body 102. Preferably, at least these major engine portions 84, 92, 94, 96, 98 are made of aluminum alloy. In some arrangements, the cylinder head cover members 94 can be unitarily formed with the respective cylinder head members 92. Also, the crankcase cover member 98 can be unitarily formed with the crankcase member 96.

The engine 32 also comprises an air intake system 106 (see FIG. 3). The air intake system 106 draws air from within the cavity 68 and supplies the air to the combustion chambers. The air intake system 106 preferably comprises six intake passages 108 and a pair of plenum chambers 110. In the illustrated arrangement, each cylinder bank is allotted with three intake passages 108 and one plenum chamber 110.

The most-downstream portions of the intake passages 108 preferably are defined within the cylinder head members 92 as inner intake passages. Thus, these portions can be integrally formed in the cylinder head members 92. The inner intake passages communicate with the combustion chambers through intake ports, which are formed at inner surfaces of the cylinder head members 92. Typically, each of the combustion chambers has one or more intake ports.

Intake valves can be slideably disposed at each cylinder head members 92 to move between an open position and a closed position. As such, the valves act to open and close the ports to control the flow of air into the combustion chamber. Biasing members, such as springs, are used to urge the intake valves toward the respective closed positions by acting between a mounting boss formed on each cylinder head member 92 and a corresponding retainer that is affixed to each of the valves. When each intake valve is in the open position, the inner intake passage that is associated with the intake port communicates with the associated combustion chamber.

Outer portions of the intake passages 108, which are disposed outside of the cylinder head members 92, preferably are defined with intake conduits 114. In the illustrated arrangement, each intake conduit 114 is formed with two pieces. One piece is a throttle body 116 in which a throttle valve assembly 118 (see FIG. 2) is positioned. The throttle valve assemblies 118 are schematically illustrated in FIG. 2. The throttle bodies 116 are connected to the inner intake passages.

Another piece is an intake runner 120 disposed upstream of the throttle body 116. The respective intake conduits 114 extend forwardly along side surfaces of the engine body 102 on both the port side and the starboard side from the respective cylinder head members 92 toward the front of the crankcase cover member 98. The intake conduits 114 on the same side preferably extend generally in parallel to each other and, more preferably, are vertically spaced apart from one another. A space S1 is formed between the engine body 102 and the intake conduits 114 on another to define spaces S1 therebetween the port side, while a space S2 is formed between the engine body 102 and the intake conduits 114 on the starboard side.

Each throttle valve assembly 118 preferably includes a throttle valve. Preferably, the throttle valves are butterfly valves that have valve shafts journaled for pivotal movement about a generally vertical axis. In some arrangements, the valve shafts are linked together and are connected to a control linkage. The control linkage would be connected to an operational member, such as a throttle lever, that is provided on the watercraft or otherwise proximate the operator of the watercraft 40. The operator can control the opening degree of the throttle valves in accordance with operator demand through the control linkage. That is, the throttle valve assemblies 118 can measure or regulate amounts of air that flow through the intake passages 108 to the combustion chambers in response to the operation of the operational member by the operator. Normally, the greater the opening degree, the higher the rate of airflow and the higher the engine speed.

The respective plenum chambers 110 preferably are defined with plenum chamber units 124 which are disposed side by side in front of the crankcase cover member 98 and are affixed thereto. Preferably, the plenum chamber units 124 are arranged substantially symmetrically relative to the longitudinal center plane 88. In the illustrated arrangement, each forward end portion of the intake runners 120 is housed within each plenum chamber unit 124.

As shown in FIG. 2, each plenum chamber unit 124 preferably has two air inlets 126, which extend generally rearwardly between the respective intake runners 120. The respective air inlets 126 define inlet openings 128 through which air is drawn into the plenum chambers 110. In one arrangement, the intake runners 120 and the air inlets 126 can be unitarily formed with the associated plenum chamber unit 124 and those three components 120, 124, 126 can be made of plastic. The respective plenum chamber units 124 preferably can be connected with each other through one or more connecting pipes 130 (see FIG. 3) to substantially equalize the internal pressures between the chamber units 124. The plenum chambers 110 coordinate or smooth air delivered to each intake passage 108 and also act as silencers to reduce intake noise.

The air within the closed cavity 68 is drawn into the plenum chambers 110 through the inlet openings 128 of the air inlets 126. The air expands within the plenum chambers 110 to reduce pulsations and then enters the outer intake passages 108. The air passes through the outer intake passages 108 and flows into the inner intake passages. The level of airflow is measured by the throttle valve assemblies 118 before the air enters the inner intake passages.

The engine 32 further comprises an exhaust system that routes burnt charges, i.e., exhaust gases, to a location outside of the outboard motor 30. In one preferred arrangement, each cylinder head member 92 defines a set of inner exhaust passages that communicate with the combustion chambers through one or more exhaust ports, which may be defined at the inner surfaces of the respective cylinder head members 92. The exhaust ports can be selectively opened and closed by exhaust valves. The construction of each exhaust valve and the arrangement of the exhaust valves are substantially the same as the intake valve and the arrangement thereof, respectively. Thus, further description of these components is deemed unnecessary.

Exhaust manifolds preferably are defined generally vertically within the cylinder block 84 between the cylinder bores of both the cylinder banks (i.e. in the valley of the v-shape). The exhaust manifolds communicate with the combustion chambers through the inner exhaust passages and the exhaust ports to collect exhaust gases therefrom. The exhaust manifolds are coupled with the exhaust discharge passage of the exhaust guide member 80. When the exhaust ports are opened, the combustion chambers communicate with the exhaust discharge passage through the exhaust manifolds.

A valve cam mechanism preferably is provided for actuating the intake and exhaust valves in each cylinder bank. Preferably, the valve cam mechanism includes a pair of camshafts 132 per cylinder bank, although one of them is not shown in the figures. The camshafts 132 are intake and exhaust camshafts. The illustrated camshafts 132 extend generally vertically and are journaled for rotation between the cylinder head members 92 and the cylinder head cover members 94. The camshafts 132 have cam lobes to push valve lifters that are affixed to the respective ends of the intake and exhaust valves in any suitable manner. The cam lobes repeatedly push the valve lifters in a timed manner, which is in proportion to the engine speed. The movement of the lifters generally is timed by rotation of the camshafts 132 to appropriately actuate the intake and exhaust valves.

A camshaft drive mechanism preferably is provided for driving the valve cam mechanism. The camshaft drive mechanism preferably comprises driven sprockets 136 positioned atop the camshafts 132, a drive sprocket 138 positioned atop the crankshaft 100 and a timing belt or chain 140 wound around the driven sprockets 136 and the drive sprocket 138. The crankshaft 100 thus drives the respective camshafts 132 through the timing belt 140 in the timed relationship. A belt tensioner 142 keeps the timing belt 140 tight on the sprockets 136, 138. The other camshaft on each bank is driven by the camshaft driven by the crankshaft 100 via another belt or chain. Because the camshafts 132 must rotate at half of the rotational speed of the crankshaft 100 in a four-cycle engine, a diameter of the driven sprockets 136 is twice as large as a diameter of the drive sprocket 138.

The engine 32 further comprises indirect, port or intake passage fuel injection as a fuel delivery system. The fuel injection system preferably comprises six fuel injectors 144 with one fuel injector allotted for each one of the respective combustion chambers. The fuel injectors 144 preferably are mounted on the throttle bodies 116 of the respective banks with a pair of fuel rails 146. The fuel rails 146 connect the fuel injectors 144 on the same banks with each other and also define portions of fuel conduits to deliver fuel to the injectors 144.

Each fuel injector 144 preferably has an injection nozzle directed downstream within the associated intake passage 108, which is downstream of the throttle valve assembly 118. The fuel injectors 144 spray fuel into the intake passages 108 under control of an electronic control unit (ECU) (not shown). The ECU controls both the initiation timing and the duration of the fuel injection cycle of the fuel injectors 144 so that the nozzles spray a proper amount of fuel each combustion cycle.

Typically, a fuel supply tank disposed on a hull of the associated watercraft 40 contains fuel for the outboard motor 30. The fuel is delivered to the fuel rails 146 through the fuel conduits. A vapor separator 150 preferably is disposed in the space S1 and along the conduits to separate vapor from the fuel and can be mounted on the engine body 102 along the port side surface. In the illustrated embodiment, the fuel injection system employs at least two fuel pumps to deliver the fuel to and from the vapor separator 150. More specifically, a lower pressure pump pressurizes the fuel toward the vapor separator 150, while a high pressure pump is applied to pressurize the fuel from the vapor separator 150.

A vapor delivery conduit 152 couples the vapor separator 150 with at least one of the plenum chambers 110. The vapor thus can be delivered to the plenum chamber 110 for delivery to the combustion chambers together with the air for combustion. The delivery conduit 152 preferably includes a check valve 153 that allows the vapor to pass therethrough when a vapor pressure in the vapor separator 150 is greater than a preset pressure and a filter 154 that removes alien substances from the vapor.

It should be noted that a direct fuel injection system that sprays fuel directly into the combustion chambers can replace the indirect fuel injection system described above. Moreover, other charge forming devices, such as carburetors, can be used instead of the fuel injection systems.

The engine 32 further comprises an ignition system. Each combustion chamber is provided with a spark plug which preferably is disposed between the intake and exhaust valves. Each spark plug has electrodes that are positioned in the associated combustion chamber and that are spaced apart from each other by a small gap. The spark plugs are connected to the ECU through ignition coils. The spark plugs generate a spark between the electrodes to ignite an air/fuel charge in the combustion chamber at selected ignition timing under the control of the ECU.

Generally, during an intake stroke of the engine 32, air is drawn into the combustion chambers through the air intake passages 108 and fuel is injected into the intake passages 108 by the fuel injectors 144. The air and the fuel thus are mixed to form the air/fuel charge in the combustion chambers. At a beginning of a power stroke, the respective spark plugs ignite the compressed air/fuel charge in the respective combustion chambers. The air/fuel charge thus rapidly burns during the power stroke to move the pistons. The burnt charge, i.e., exhaust gases, then are discharged from the combustion chambers during an exhaust stroke following the power stroke.

The engine 32 may comprise a cooling system, a lubrication system and other systems, mechanisms or devices other than the systems described above. Such systems can be arranged in any suitable manner.

A flywheel assembly 156, which is schematically illustrated with phantom line in FIG. 3, preferably is positioned atop the crankshaft 100 and is mounted for rotation with the crankshaft 100. The flywheel assembly 156 comprises a flywheel magneto or AC generator that supplies electric power directly or indirectly (e.g., via a battery 158) to various electrical components such as the fuel injection system, the ignition system and the ECU. The illustrated battery 158 is placed on a hull of the watercraft 40 and is connected to cable terminals 160, 162 located in the outboard motor 30 through a battery cable assembly 163. This battery cable layout will be described in greater detail later with additional reference to FIGS. 4 and 5.

The flywheel assembly 156 further comprises a ring gear 164 that meshes with a gear 166 of a starter motor 168 which is mounted on the crankcase cover member 98. The starter motor 168 can be powered by the battery 158 via a starter switch. As is well known, when the operator of the outboard motor 30 turns the switch on, the gear 166 of the starter motor 168 turns to rotate the ring gear 164 meshed with the starter gear 166. Because the ring gear 164 is affixed to the crankshaft 100, rotation of the ring gear 164 rotates the crankshaft 100 to start the engine 32. The starter motor 168 has a one-way clutch that prevents the starter gear 166 from being rotated by the ring gear 164.

In the illustrated arrangement, an engine cover 170 extends over almost all of the engine 32 including the flywheel assembly 156 and the starter motor 168.

With reference again to FIG. 1, the driveshaft housing 62 depends from the power head 58 and supports a driveshaft, which is coupled with the crankshaft 100 and which extends generally vertically through the driveshaft housing 62. The driveshaft is journaled for rotation and is driven by the crankshaft 100. The driveshaft housing 62 preferably defines an internal section of the exhaust system that leads the majority of exhaust gases to the lower unit 64. The internal section includes an idle discharge portion that branches off of a main portion of the internal section such that idle exhaust gases can be discharged directly out to the atmosphere through a discharge port that is formed on a rear surface of the driveshaft housing 62.

The lower unit 64 depends from the driveshaft housing 62 and supports a propulsion shaft that is driven by the driveshaft. The propulsion shaft extends generally horizontally through the lower unit 64 and is journaled for rotation. A propulsion device is attached to the propulsion shaft. In the illustrated arrangement, the propulsion device is a propeller 174 that is affixed to an outer end of the propulsion shaft. The propulsion device, however, can take the form of a dual counter-rotating system, a hydrodynamic jet, or any of a number of other suitable propulsion devices.

A transmission preferably is provided between the driveshaft and the propulsion shaft, which lie generally normal to each other (i.e., at a 90° shaft angle) to couple together the two shafts by bevel gears. The outboard motor 30 has a clutch mechanism that allows the transmission to change the rotational direction of the propeller 174 among forward, neutral and reverse.

The lower unit 64 also defines an internal section of the exhaust system that is connected with the internal exhaust section of the driveshaft housing 62. At engine speeds above idle, the exhaust gases generally are discharged to the body of water surrounding the outboard motor 30 through a discharge section defined within the hub of the propeller 174.

With reference still to FIGS. 1–3 and additional reference to FIGS. 4 and 5, the battery cable layout, which includes the cable terminals 160, 162, will now be described in greater detail.

In the illustrated arrangement, a bracket 180 preferably extends from the engine body 102 to support the cable terminal 160 and to define the cable terminal 162. In one presently preferred arrangement, one end of the bracket 180 is secured to a side surface of the crankcase member 96 and the crankcase cover member 98 on the starboard side by a plurality of bolts 182. With reference now to FIG. 2, a set of bolt holes 183 correspond to the bolts 182. Other locations and methods of securing the bracket 180 also can be used.

A body of the bracket 180 substantially exists in the space S2 that is defined between the engine body 102 and the intake conduits 114. In one presently preferred arrangement, at least one end is secured in the space S2. An aperture 184 preferably is defined in the body to reduce weight of the bracket 180. The other end (extended end) of the illustrated bracket 180 advantageously is bifurcated to define two support sections 186, 188. The cable terminal 160 is mounted onto the support section 186, while the other support section 188 itself defines the cable terminal 162. The bracket 180 preferably is made of conductive material such as, for example, an aluminum alloy or an iron alloy.

The cable terminal 160 preferably comprises a coupling member 192 and a holder 194. The coupling member 192 in the illustrated arrangement is a tubular member or a sleeve made of metal material. An inner surface of the coupling member 192 preferably is screw threaded.

The illustrated holder 194 comprises a mount section 196 and a holder section 198. The mount section 196 preferably comprises a piece of conductive sheet metal. The illustrated mount section 196 defines a circular through-hole 200. The holder section 198 preferably comprises a plastic block that can be unitarily formed with the mount section 196 so that at least the through-hole 200 and surrounding areas of the through-hole 200 are filled with and covered by the plastic block. Accordingly, in one particularly preferred construction, the holder section 198 is thicker than the mount section 196 and is generally non-conductive.

An opening 204 extends into the holder section 198. The opening 204 preferably has an inner diameter smaller than an inner diameter of the through-hole 200 and the opening 204 preferably is positioned within the through-hole 200. The tubular coupling member 192 preferably extends through the opening 204. Because of this arrangement, the coupling member 192 is insulated from the mount section 196 by the holder section 198, which is made of plastic, i.e., non-conductive material.

The mount section 196 of the holder 194 is affixed to the support section 186 of the bracket 180 by a bolt 206 such that the holder section 198 depends generally below the support section 186. The coupling member 192 is held by the holder 194 and thus is disposed generally within the space S2. The coupling member 192 also is positioned generally between the lower-most intake conduit 120, which is indicated by the reference numeral 120A, and the intake conduit disposed next to the conduit 120A, which is indicated by the reference numeral 120B. In other words, the illustrated coupling member 192 is located generally above the intake conduit 120A and generally below the intake conduit 120B.

The coupling member 192 has two coupling ends positioned on opposite sides of the holder section 198 relative to each other. A first cable 210 connects one of the coupling end which faces the engine body 102 with an anode terminal 212 of the starter motor 168. That is, one end 214 of the cable 210 abuts on this coupling end and a bolt 216 is fitted into the threaded hollow of the coupling member 192 to fix the end of the cable 210 to the coupling member 192. Another end 218 of the cable 210 in turn abuts on the anode terminal 212 and a bolt 220 is affixed thereto to hold the end of the cable 210 to the terminal 212. The cable 210 extends within the space S2. Boots or caps 222 made of rubber preferably cover both ends 214, 218 of the cable 210 to protect those connecting portions from water or other foreign substances.

A second cable 226 can connect the other coupling end, which faces outward, with an anode terminal 228 of the battery 158. When the outboard motor 30 is manufactured, the second cable 226 preferably is not yet coupled with the coupling member 192 and is only coupled with the anode terminal 228 of the battery 158 on the watercraft 40. The user, therefore, connects the cable 226 to the coupling end of the coupling member 192 when the outboard motor 30 is mounted onto the associated watercraft 40.

The coupling end facing outward is positioned to expose itself between the intake conduits 120A, 120B because the coupling member 192 is disposed at this location. This arrangement can provide easy access to the cable terminal 160. Moreover, the illustrated cable 226 has a crank-shaped metallic member 230 welded to a core wire 232 of one end of the cable 226. One end 234 of the crank-shaped member 230 abuts on the coupling end and a bolt 236 is fitted into the threaded hollow of the coupling member 192 to fix the end of the member 230 to the coupling member 192. The other end of the cable 226 is connected to the anode terminal 228 of the battery 158 as described above. A boot or cap 242 made of rubber preferably covers the crank-shaped member 230 and a tip portion of the core wire 232 of the cable 226 to protect those connecting portions from water or other foreign substances.

A third cable 246 can directly connect the support section 188 of the bracket 180 with a cathode terminal 248 of the battery 158. The term "directly" means that the third cable 246 can be coupled with the support section 188 of the bracket 180 without any intermediate member such as a coupling member. Thus, the support section 188 preferably defines the second cable terminal 162 as noted above. Like the second cable 226, when the outboard motor 30 is manufactured, the third cable 246 is not yet coupled with the bracket 180 but is only coupled with the cathode terminal 248 of the battery 158 on the watercraft 40. The user, therefore, connects the third cable 246 to the support section 188 of the bracket 180 together with the second cable 226 connected to the coupling member 192 when the outboard motor 30 is mounted onto the associated watercraft 40.

Figure 4:
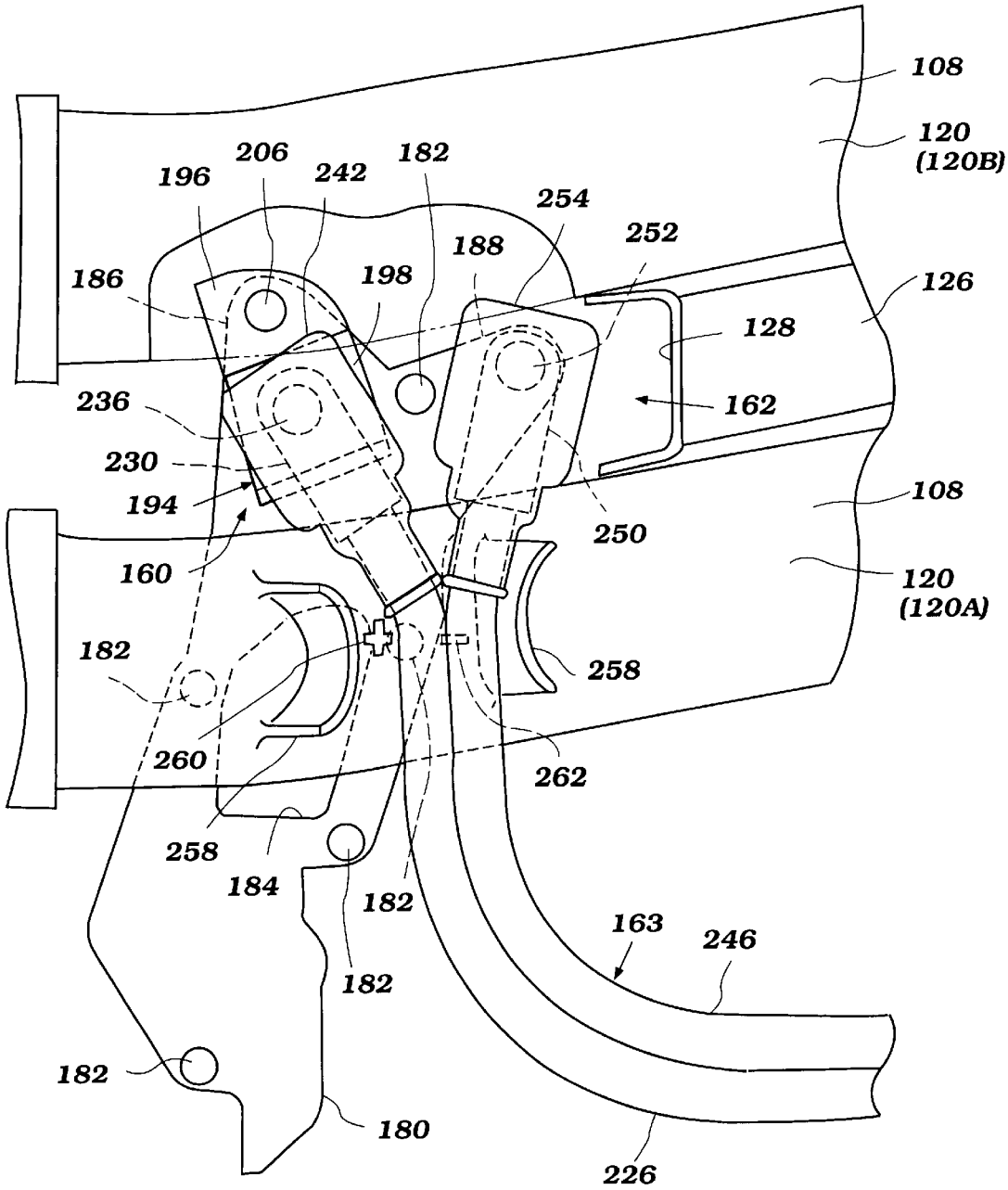
FIG. 4 is an enlarged partial side elevational view of the engine illustrating a construction around the cable terminals.
Figure 5:
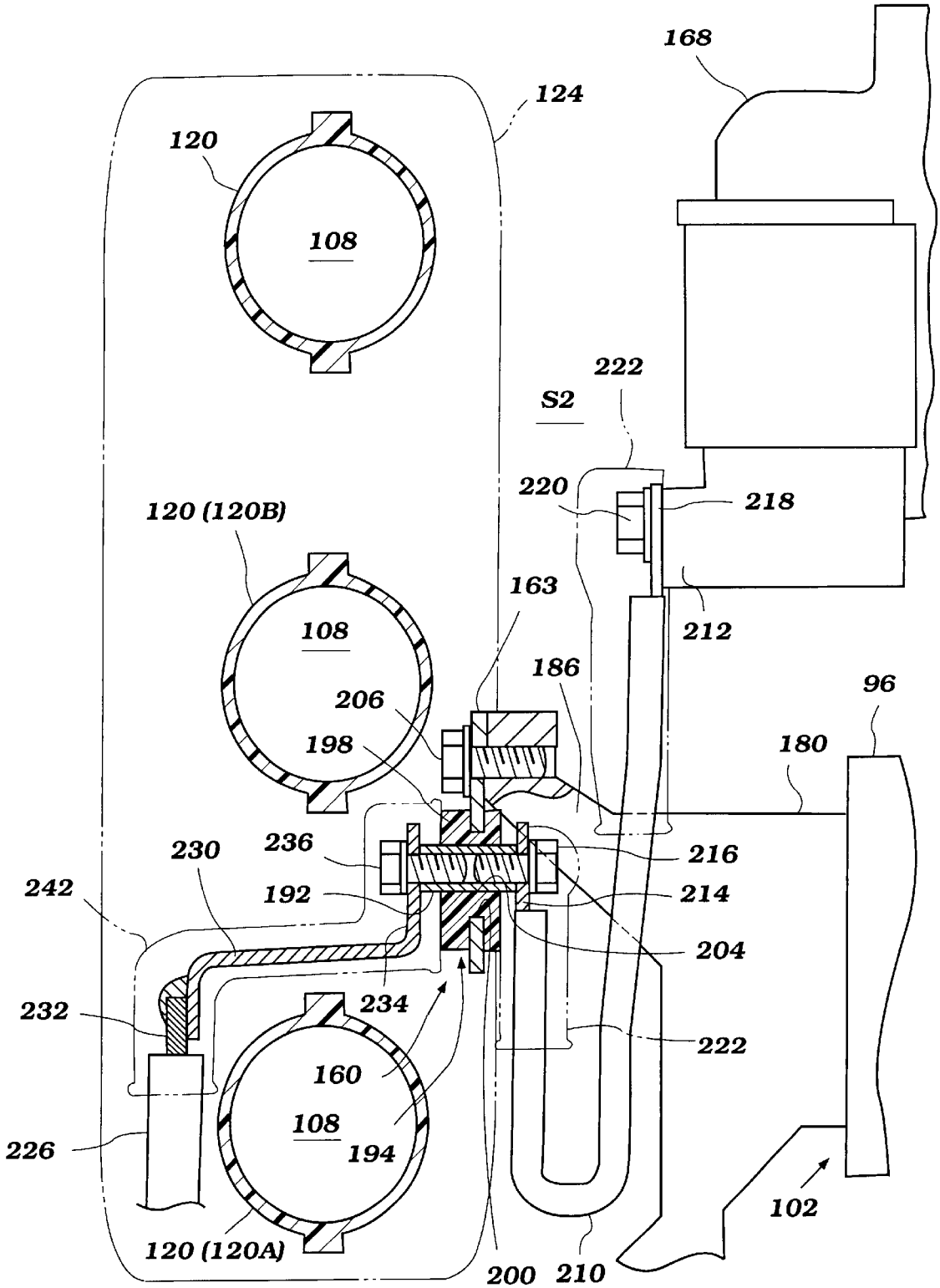
FIG. 5 is an enlarged partial rear view of the engine further illustrating the construction around the cable terminals.

As best shown in FIG. 4, the support section 188 of the bracket 180 is positioned to expose itself between the intake conduits 120A, 120B like the coupling member 192 disposed at a similar location. This arrangement can provide easy access to the support section 188 of the bracket 180. The illustrated third cable 246 also has a crank-shaped metallic member 250 welded to a core wire of one end of the cable 246. The crank-shaped member 250 preferably is the same as the crank-shaped member 230 described above. One end of the crank-shaped member 250 abuts on the support section 188 of the bracket 180. A bolt 252 fastens the end of the crank-shaped member 250 to the support section 188 of the bracket 180. FIG. 2 shows a bolt hole 253 corresponding to the bolt 252. The other end of the cable 246 is connected to the cathode terminal 248 of the battery 158 as described above. A boot or cap 254 made of rubber preferably covers the crank-shaped member 250 and a tip portion of the core wire of cable 246 to protect those connecting portions from water or other alien substances.

As described above, the support sections 186, 188 of the bracket 180 are disposed within the space S2 formed between the engine body 102 and the intake conduits 120. Because of the arrangement, the bracket 180 can be short enough to inhibit conspicuous vibration from occurring at the bolts 206, 216, 236, 252. Accordingly, the bolts 206, 216, 236, 252 hardly are loosen.

Both the second and third cables 226, 246 preferably are united to define the battery cable assembly 163. The battery cable assembly 163 can pass through an opening formed at a forward end portion of the bottom cowling member 72, together with various cables, wires, hoses and linkage members. Preferably, a pair of arc-shaped guide projections 258 together extend from a side surface of the lower-most intake conduit 120A. The guide projections 258 are spaced apart from each other and the battery cable assembly 163 can go through the space defined by the guide projections 258. In addition, marks "+(plus)" 260 and "–(minus)" 262 are embossed on the intake conduit 120A between the guide projections 258. The marks 260, 262 are useful for the user or someone who makes a wiring work because the marks can well guide the person to place the cables 226, 246 at appropriate terminals.

Of course, the foregoing description is that of a preferred construction having certain features, aspects and advantages in accordance with the present invention. Various changes and modifications may be made to the above-described arrangements without departing from the spirit and scope of the invention, as defined by the appended claims. For instance, the holder of the cable terminal can be unitarily formed with the bracket. A non-conductive sleeve can replace the holder section of the holder. A coupling member which has a solid portion at a center thereof can replace the completely tubular coupling member. Accordingly, the scope of the present invention should not be limited to the illustrated configurations, but should only be limited to a fair construction of the claims that follow and any equivalents of the claims.

What is claimed is:

1. An internal combustion engine for an outboard motor comprising an engine body, a moveable member moveable relative to the engine body, the engine body and the moveable member together defining at least one combustion chamber, an air intake system comprising an intake conduit extending along at least part of the engine body and communicating with the at least one combustion chamber, a cable terminal disposed generally in a space formed between the engine body and the intake conduit, the cable terminal comprising a coupling member having a first coupling end and a second coupling end, the first coupling end being connected to at least one electrical component of the engine by a first cable extending at least in part within the space, the second coupling end positioned to expose itself either above or below the intake conduit and being adapted to be connected to an anode of a battery by a second cable.

2. The engine as set forth in claim 1 additionally comprising a bracket extending from the engine body to support the cable terminal.

3. The engine as set forth in claim 2, wherein the cable terminal additionally comprises a holder having a non-conductive portion, the holder being joined to the coupling member.

4. The engine as set forth in claim 3, wherein the non-conductive portion of the holder defines an opening, the coupling member extends through the opening, and both the first and second coupling ends are positioned on opposite sides of the non-conductive portion relative to each other.

5. The engine as set forth in claim 1 additionally comprising a second coupling terminal disposed generally in the space to expose itself either above or below the intake conduit, and the second coupling terminal being adapted to be connected to a cathode of the battery by a third cable.

6. The engine as set forth in claim 5 additionally comprising a bracket extending from the engine body to support the first cable terminal and to define the second cable terminal.

7. The engine as set forth in claim 1, wherein the coupling member forms a tubular portion at least at the first coupling end, and one end of the first cable is affixed to the first coupling end by a fastener having a shaft fitted into the tubular portion.

8. The engine as set forth in claim 7, wherein the inner surface of the tubular portion and the shaft of the fastener are screw threaded.

9. The engine as set forth in claim 1, wherein the coupling member forms tubular portions at both the coupling ends, one end of the first cable is affixed to the first coupling end by a first fastener having a first shaft fitted into one of the tubular portions, and one end of the second cable is affixed to the second coupling end by a second fastener having a second shaft fitted into another one of the tubular portions.

10. The engine as set forth in claim 1, wherein the intake system comprises a plurality of the intake conduits, and the second coupling end is positioned to expose itself between two of the intake conduits.

11. An internal combustion engine for an outboard motor comprising an engine body, a moveable member moveable relative to the engine body, the engine body and the moveable member together defining at least one combustion chamber, an air intake system arranged to introduce air to the combustion chamber, the intake system comprising an intake conduit extending along at least part of the engine body, and a cable terminal disposed generally in a space formed between the engine body and the intake conduit, the cable terminal being positioned to expose itself either above or below the intake conduit and being adapted to be connected to a cathode of a battery by a cable.

12. The engine as set forth in claim 11 additionally comprising a bracket extending from the engine body to define the cable terminal.

13. The engine as set forth in claim 12, wherein the intake system comprises a plurality of the intake conduits, and the cable terminal is positioned to expose itself between two of the intake conduits.

14. An internal combustion engine for an outboard motor comprising an engine body, a moveable member moveable relative to the engine body, the engine body and the moveable member together defining at least one combustion chamber, an air intake system arranged to introduce air to the combustion chamber, the intake system comprising an intake conduit extending along at least part of the engine body, and at least one cable terminal disposed generally in a space formed between the engine body and the intake conduit, the cable terminal being positioned to expose itself either above or below the intake conduit and being adapted to be connected to an anode or cathode of a battery by a cable.

15. The engine as set forth in claim 14 additionally comprising a bracket extending from the engine body to support or define the cable terminal.

16. The engine as set forth in claim 15 comprising first and second cable terminals, the first cable terminal comprising a coupling member and a holder, the holder having a non-conductive portion that holds the first coupling member, the bracket supporting the first coupling member via the holder, the coupling member being connected to at least one electrical component of the engine and being adapted to be connected to the anode of the battery.

17. The engine as set forth in claim 14, wherein the intake system comprises a plurality of the intake conduits, and the cable terminal is positioned to expose itself between two of the intake conduits.

* * * * *